US007194945B2

(12) United States Patent
O'Dwyer

(10) Patent No.: US 7,194,945 B2
(45) Date of Patent: Mar. 27, 2007

(54) PROJECTILE FIRING APPARATUS

(75) Inventor: James Michael O'Dwyer, Sinnamon Park (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 10/790,068

(22) Filed: Mar. 2, 2004

(65) Prior Publication Data

US 2007/0039456 A1 Feb. 22, 2007

Related U.S. Application Data

(62) Division of application No. 09/958,465, filed as application No. PCT/AU00/00297 on Apr. 7, 2000, now Pat. No. 6,722,252.

(30) Foreign Application Priority Data

Apr. 7, 1999 (AU) ..... PP9613
Nov. 3, 1999 (AU) ..... PQ3843

(51) Int. Cl.
*F41A 19/64* (2006.01)

(52) U.S. Cl. ..... 89/135; 89/127

(58) Field of Classification Search ..... 89/126, 89/127, 1.41, 135, 8; 102/438
See application file for complete search history.

(56) References Cited

U.S. PATENT DOCUMENTS 200,740 A * 2/1878 Lyman ..... 89/8
484,011 A * 10/1892 Haskell ..... 89/8
694,896 A * 3/1902 Scott ..... 102/438
2,313,030 A 3/1943 Tauschek
3,169,333 A 2/1965 Scanlon, Jr.
3,395,478 A 8/1968 Harvey
3,854,231 A 12/1974 Broyles
3,899,975 A * 8/1975 Lawrence ..... 102/505
3,952,658 A 4/1976 Broyles
4,012,985 A 3/1977 Magnusson
4,024,790 A 5/1977 Heiderer
4,549,489 A * 10/1985 Billard et al. ..... 102/505
4,586,439 A * 5/1986 Wrana ..... 102/438
H000669 H * 9/1989 Thomas, Sr. ..... 102/370
5,042,388 A 8/1991 Warren et al. ..... 102/434

(Continued)

FOREIGN PATENT DOCUMENTS

AU 38985/72 8/1973

(Continued)

OTHER PUBLICATIONS

Supplementary Partial European Search Report for International Application No. PCT/AU000297.

*Primary Examiner*—Stephen M. Johnson
(74) *Attorney, Agent, or Firm*—Finnegan, Henderson, Farabow, Garrett & Dunner, L.L.P.

(57) ABSTRACT

A barrel assembly with a barrel is provided. The barrel comprises a plurality of external chambers containing respective propellant charges, a plurality of projectiles stacked nose to tail within the barrel and comprising respective expansion spaces for propellant gases, and a control system configured to ignite the propellant charges to create the propellant gases and propel the projectiles sequentially from the barrel. Each projectile has a corresponding external chamber and an expansion space and each chamber comprises a port that conveys propellant gas from the chamber into the expansion space for propulsion of the respective projectile.

1 Claim, 7 Drawing Sheets

U.S. PATENT DOCUMENTS

| | | | | |
|---|---|---|---|---|
| 5,133,242 | A | 7/1992 | Witt | 89/8 |
| 5,404,789 | A | 4/1995 | Haas | 89/1.2 |
| 5,883,329 | A * | 3/1999 | O'Dwyer | 102/217 |
| 6,123,007 | A | 9/2000 | O'Dwyer | 89/135 |
| 6,138,395 | A | 10/2000 | O'Dwyer | 42/84 |
| 6,223,642 | B1 | 5/2001 | O'Dwyer | 89/7 |
| 6,301,819 | B1 | 10/2001 | O'Dwyer | 42/84 |
| 2002/0134226 | A1 * | 9/2002 | O'Dwyer | 89/135 |

FOREIGN PATENT DOCUMENTS

| | | |
|---|---|---|
| DE | 2752844 A1 | 11/1977 |
| DE | 3643 197 A1 | 6/1988 |
| DE | 4014 192 | 11/1991 |
| FR | 2 262 278 | 9/1975 |
| GB | 1594 686 | 8/1981 |
| WO | WO 94/20809 | 9/1994 |
| WO | WO98/55819 | 12/1998 |
| WO | WO98/55824 | 12/1998 |
| WO | WO 98/55824 | 12/1998 |

* cited by examiner

PROJECTILE FIRING APPARATUS

This application is a divisional of U.S. patent application Ser. No. 09/958,465, filed Feb. 26, 2002 now U.S. Pat. No. 6,722,252, which is the National Stage of International Application No. PCT/AU00/00297, filed Apr. 7, 2000; additionally, this application claims the priority to Australian Application No. PP 9613, filed on Apr. 7, 1999, and Australian Application No. PQ 3843, filed on Nov. 3, 1999, all of which are incorporated herein by reference.

TECHNICAL FIELD

This invention relates to projectiles and firing apparatus therefore and it has particular application to methods of and apparatus for firing projectiles for military use, although this invention is also applicable to civilian uses such as described in our simultaneously filed International application PCT/AU00/00296.

BACKGROUND ART

The military applications of firing projectiles are well known, such as firing grenades, firing radar deflecting chaff and missile decoy packages. In military applications such as firing grenades, each cartridge case carries a projectile assembly containing a single grenade. Accordingly the relatively slow rate of delivery of grenades provides a significant constraint on the applications or utility of the equipment.

This invention has particular application to projectiles which are fired from a barrel assembly having a plurality of projectiles arranged in-line within the barrel and which are associated with discrete selectively ignitable propellant charges for propelling the projectiles sequentially through the muzzle of the barrel. Sealing engagement is provided between projectiles and barrel so as to prevent rearward travel of an ignited propellant charge to the trailing propellant charge. Such barrel assemblies will be referred to hereinafter as of the type described. Such arrangements are illustrated in our earlier International Patent Applications.

Barrels assemblies of the type described have the disadvantage that significant time may be required to position them for firing on a selected target. This set-up time may be unsuitable for applications where time is of the essence, such as for setting up defences.

OBJECTS OF THIS INVENTION

This invention aims to provide improved means for debilitating an enemy and/or to alleviate one or more of the shortcomings associated with presently available methods of and apparatus for firing projectiles for military and/or civilian uses.

DISCLOSURE OF INVENTION

With the foregoing in view, this invention in one aspect resides broadly in a plurality of barrel assemblies of the type described arranged in a transportable pod whereby the barrels may be transported to and directed at a selected target.

The pod may be formed as a unitary housing or it may have side walls which can splay outwardly to accommodate the barrel assemblies contained therein when in a splayed attitude. The pod may include aiming means for selectively orienting the barrels within the pod whereby the barrels may be directed at a selected target, alternatively, the pod may include an adjustable support such as a turret mounting.

Then again the transportable pod may be carried in a vehicle which may be selectively oriented about any desired axis to direct the barrels at a selected target, such as an aircraft whereby fixed orientation of the pod and barrel assemblies is appropriate.

Such pods will require minimal set-up time for firing many projectiles at a selected target. This will be advantageous where time is of the essence, such as for establishing defences.

Suitably the barrel assemblies are of the low pressure type which fire grenade-like projectiles although high muzzle pressure barrel assemblies may be utilised if desired. Respective barrel assemblies in the pod may be loaded with different projectiles and the pod may, include barrel assemblies having different size bores.

Suitably each projectile includes a trailing collar assembly captively mounted to the projectile body and when stored in the barrel, extend rearwardly to wedge against the nose portion of a trailing projectile body. Suitably the wedging action is provided by a shallow wedge whereby, in use, the trailing end of the collar is expanded into operative sealing engagement with the barrel.

The trailing collar may be mounted for limited axial movement relative to the projectile body and the leading end of the collar formed with an annular sealing face engageable with a complementary face formed on the projectile body whereby rearward movement of the projectile body resulting from the reaction of propellant gases thereon forces the its complementary face into sealing engagement with the annular sealing face at the leading end of the collar.

The complementary face and the annular sealing face could extend substantially radially and could be formed with complementary sealing features thereon. Preferably however these faces are complementary part-conical sealing faces which wedge into tight sealing engagement with one another. The leading end part may also be expandable into operative sealing engagement with the barrel. Suitably however the wedging, between the part-conical faces are relatively steep faces whereby the leading end of the collar is not expanded into operative sealing engagement with the barrel by the wedging action.

Preferably, each projectile is associated with a high pressure propellant chamber which exhausts to respective low pressure propulsion chambers formed between the adjacent projectiles for efficient low muzzle velocity operation. The high pressure propellant chambers could be formed integrally with the projectile body or the trailing collar or they could be provided at the exterior of the barrel to communicate therewith through ports provided through the barrel wall.

The projectiles may be electronically fired at an infinitely variable frequency up to the maximum rate of fire. For firing from a barrel assembly according to an aspect of this invention and arranged for low pressure, low muzzle velocity, the rate of firing is limited by the time taken for each projectile to leave the barrel and by the time necessary for the gas pressure in the barrel to drop sufficiently to warrant the firing of the next projectile.

In another aspect his invention resides broadly in a weapon having a plurality of barrel assemblies of the type described arranged in a transportable pod having:— a pod housing;

support means for stably supporting the pod housing;

a plurality of barrel assemblies of the type described supported in spaced relationship within said pod housing by respective swivel mounts, and direction control means for selectively varying the relative alignment between the barrel assemblies so as to selectively vary the relative delivered positions of projectiles fired from different barrels at the target The direction control means may permit uniform pivoting of the barrel assemblies so that the inclination of the axes of the barrel assemblies relative to a pod axis may be selectively varied to enable a target position relative to the pod to be varied. The direction control means may permit individual pivoting of each barrel assembly so that the inclination of each barrel axis relative to a pod axis may be individually varied to enable a target position or individual target positions relative to the pod to be varied. Such individual control may be associated with individual firing control of each barrel assembly if desired.

Then again the direction control means may permit a controlled splaying of all barrel assemblies so that the area covered at the target zone may be selectively varied. Alternatively the direction control means may permit all or some of the above variations to be achieved individually or collectively as required.

The pod housing may be of any suitably configuration and may taper towards its base to enable barrel assemblies to be supported in a splayed attitude. The support means may be fold out legs which may be adjustable if desired. In one form the pod has a rectangular pod housing for economy or ease of storage and/or transport and the base thereof constitutes the support means.

The barrel assembly variants disclosed herein may also constitute further aspects of this invention.

A pod of barrel assemblies according to aspects of this invention may be fired from a marine platform into water, or from a sled towed underwater. The pod may also be fired from an aircraft, or from a number of aircraft flying in formation and if desired, with the firing coordinated between the aircraft by a suitable electronic link.

BRIEF DETAILS OF THE DRAWINGS

In order that this invention may be more readily understood and put into practical effect, reference will now be made to the accompanying drawings which illustrate typical embodiments of the invention, wherein:—

FIGS. 1 to 4 diagrammatically illustrate typical barrel assemblies according to this invention;

DETAILED DESCRIPTION OF PREFERRED EMBODIMENTS

Figure 1:
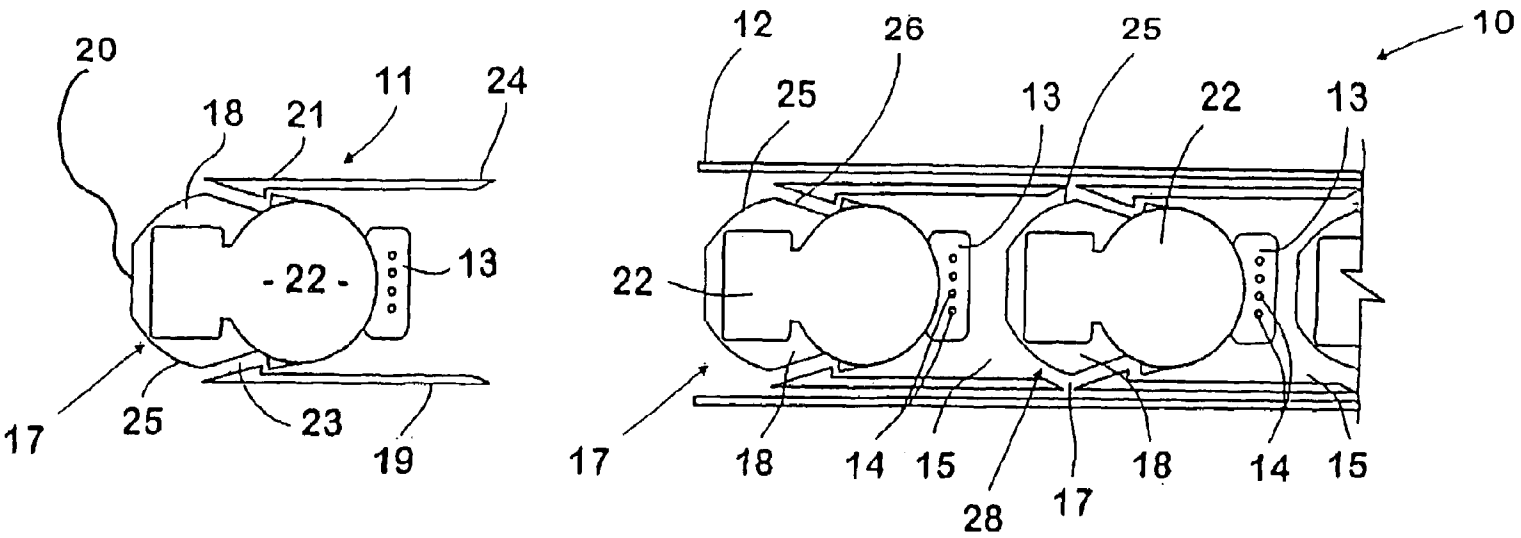

The barrel assembly 10 illustrated in FIG. 1 has multiple grenade carrying projectiles 11, for grenades of substantially known forms loaded or stacked in a rifled barrel 12 to impart spin upon firing for activating an arming device.

However a rupturable propellant cup or high pressure chamber 13 is fixed to the projectile 11 for discharging from the barrel with the projectile to clear the barrel 12 for firing the following projectile. This chamber 13 exhausts through ports 14 into the barrel space between the stacked projectiles 11, which space forms a low pressure chamber 15.

Each projectile 11 includes a projectile body 17, which in this embodiment is a grenade housing 18 housing a grenade 22, and a trailing sleeve or collar assembly 19 which is retained thereon for limited axial movement relative to a head part 20 of the grenade housing 18. The sleeve 19 has a leading end which tapers inwardly to an internal collar 21 which extends into a complementary shaped external recess 23 formed in the grenade housing 18. The sleeve 19 tapers outwardly at its rear end 24 to engage over a corresponding tapered leading face 25 on the head part or nose 20 of the projectile 11 stacked therebehind.

In use, as disclosed in our earlier inventions, loading or storing of the projectiles 11 into the barrel 12 forms a wedge type seal 26 between the leading end of the sleeve 19 and the trailing tapered face 26 of the head part 20 of the grenade housing 18, which seal prevents the ignition of the leading propellant spreading about the grenade housing to the propellant in the following round.

Loading also effects a further wedge type seal 28 between the rear end 24 of the trailing sleeve or collar assembly 19 and the leading face 25 of the head part 20 and expands the rear end 24 into operative sealing engagement with the barrel 12. Thus the sleeve or collar assembly to barrel seal forms a barrier to spreading of ignition thereabout to propellant charge in the trailing round.

Loading also effects a further wedge type seal 28 between the rear end 24 and the leading face 25 and expands the rear end 24 into operative sealing engagement with the barrel 12. Thus the sleeve forms a barrier to spreading of ignition thereabout to propellant charge in the trailing round.

Firing of the leading projectile 11 releases the leading seal while maintaining the sleeve 19 captive with the grenade housing 18 but maintains an operative seal at the rear end of the sleeve with the barrel 12. As the pressure propelling the projectile is relative low, in the order of 3000 psi, only minimal sealing is required.

Figure 2:
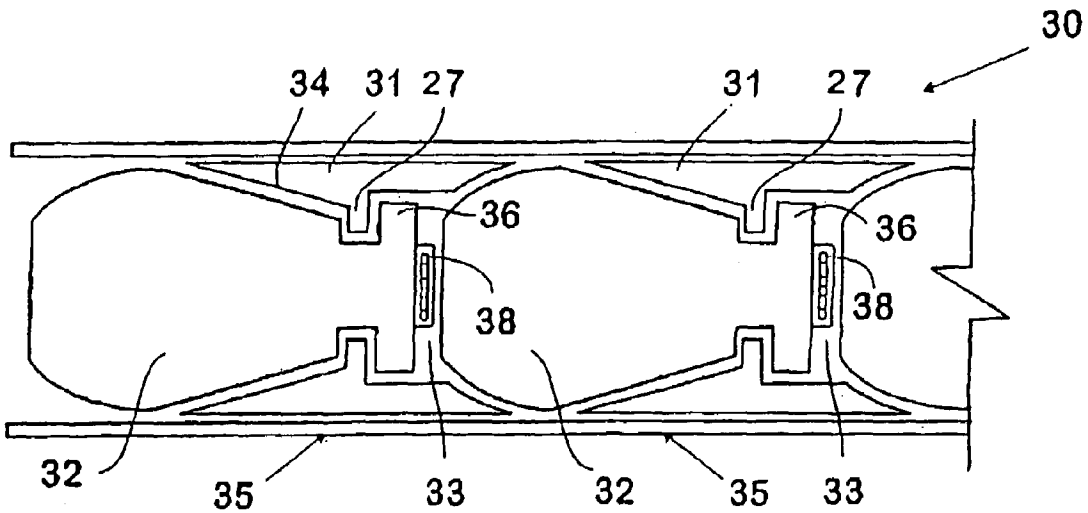

The barrel assembly 30 illustrated in FIG. 2 is similar in configuration to that illustrated in FIG. 1, the main difference being the manner in which the sleeve or collar assembly 31 is retained on the projectile body or grenade housing 32 and the configuration in which the sleeve 31 confines a smaller low pressure chamber 33 between adjacent projectiles 35 into which the high pressure chamber 36 exhausts through ports 38.

The sleeve 31 also has a shallow wedge 34 at its leading end which may be expanded into sealing engagement with the barrel during loading but which is released upon firing during the initial forward movement of the housing 32 and upon subsequent impact of the propellant chamber 36 with the back face of the return 27.

Figure 3:
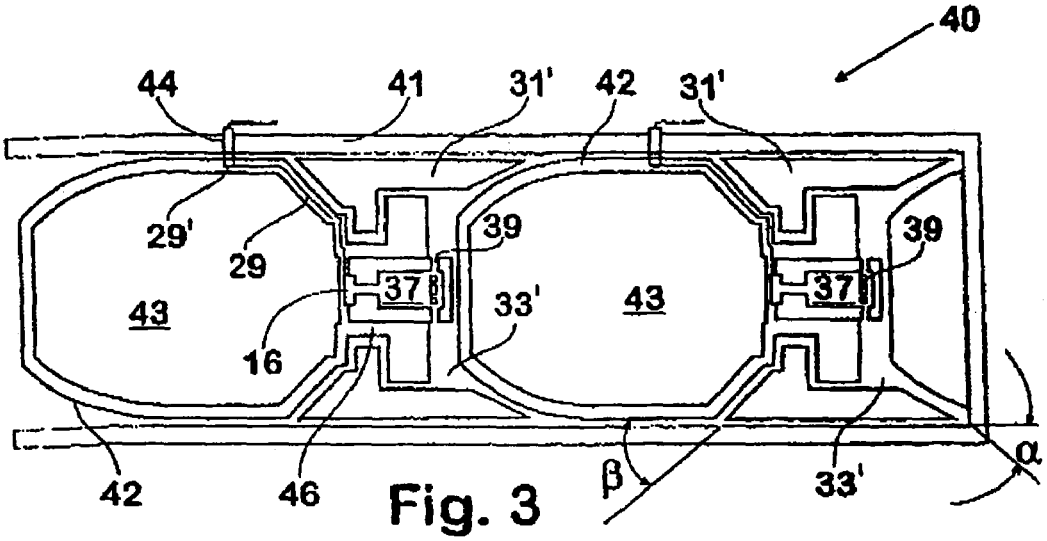

The barrel assembly 40 illustrated in FIG. 3 is also similar in configuration to that illustrated in FIG. 1, the main difference being the wedge sealing angles $\alpha$ and $\beta$ between the trailing sleeve 31' and the projectile housing 42. In this embodiment which is more suited to low pressure low muzzle velocity applications, the opposed ends of the trailing sleeve 31' formed by the sealing angles $\alpha$ and $\beta$ of between 30° and 55° are sufficiently blunt as to resist outward splaying into sealing engagement with the barrel under the influence of propellant pressures. Typically these would be in the order of 3000 psi to 5,000 psi with muzzle velocities of about 70 m/sec and 250 m/sec respectively.

Figure 11:
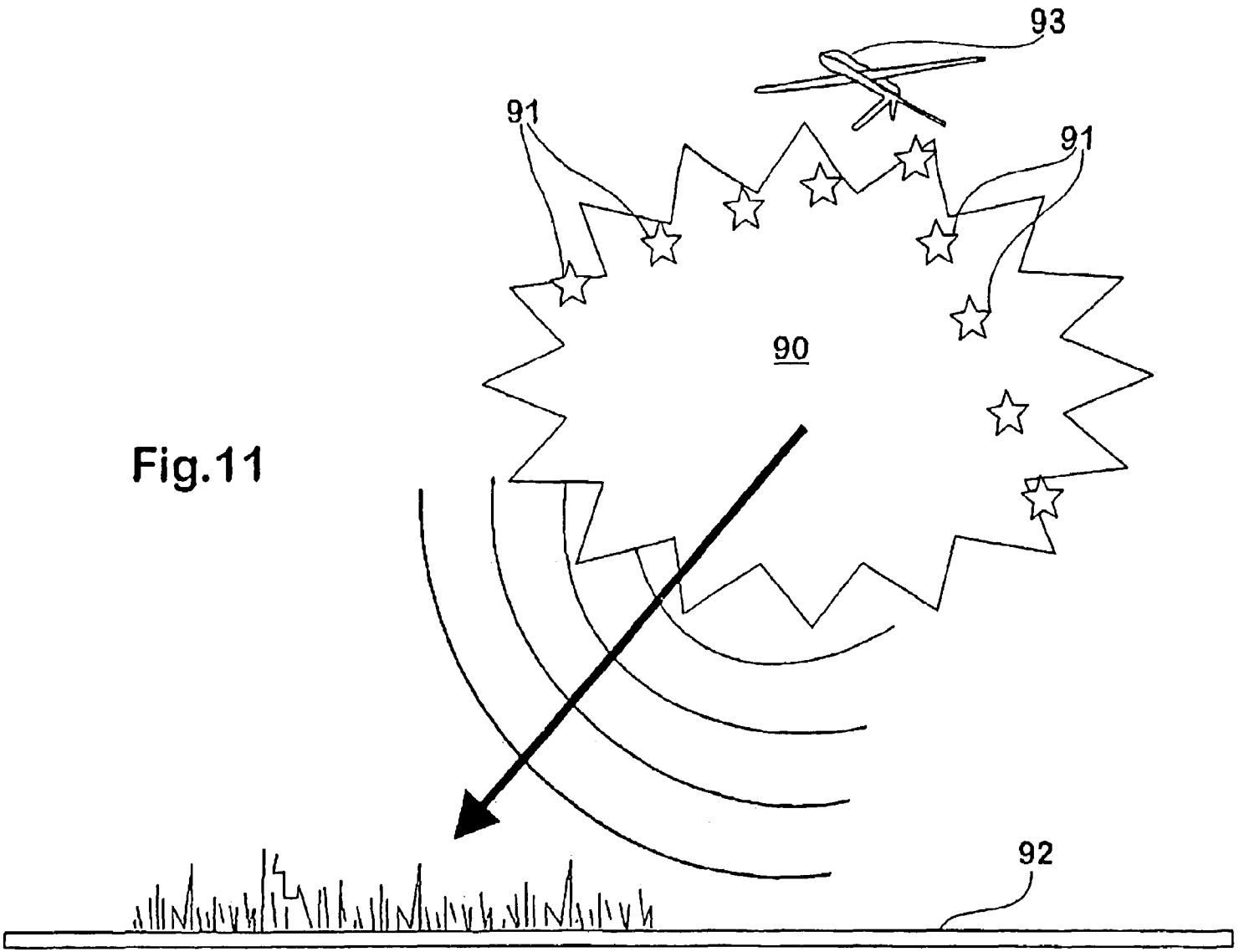
FIG. 11 illustrates a typical application of one aspect of this invention.

It will be seen that the bulbous nose part 43 of the projectile housing 42 is hollow for carrying explosives, or fuel as referred to in relation to FIG. 11. As in the embodiments illustrated in FIGS. 1 and 3 the propellant 37 in the high pressure chamber 46 is selectively ignited to expel high pressure gases through the trailing ports 39 into the low pressure chamber 33' by a detonator 16. The detonator 16 is triggered through an electrical circuit which uses the projectile column as one part of the circuit, the barrel 41 being made of insulating material or so lined and with the circuit completed by an embedded insulated wire 29 leading from the primer 16 to a contact 29' on the projectile surface which is aligned when loaded, with a complementary contact 44 supported in the barrel 41.

Alignment of the contacts can be achieved in a barrel and projectile located by rifling grooves during the loading process. In a non rifled design, the use of a annular contact in the barrel wall can achieve a similar result.

Figure 4:
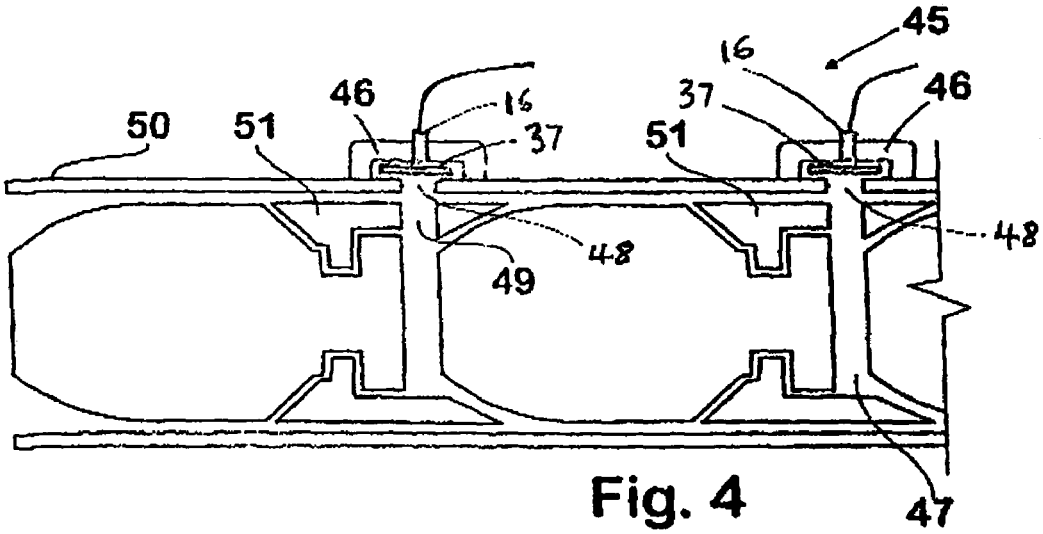
Figure 5:
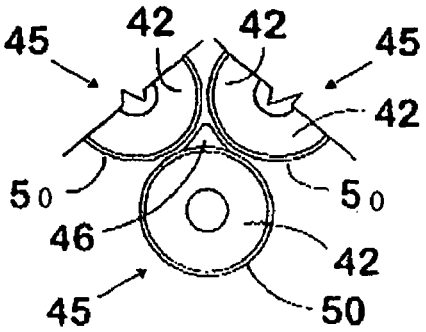
FIG. 5 is a diagrammatic cutaway end view of a cluster of barrel assemblies.

The barrel assembly 45 illustrated in FIG. 4 substantially corresponds in mechanical configuration to the FIG. 3 embodiment. However the high pressure chamber 46 is disposed externally of the barrel and communicates with the low pressure chamber 47, which acts as an expansion space, through aligned ports 48 and 49 in the wall of the barrel 50 and trailing sleeve 51, respectively. As shown cutaway in FIG. 5 the high pressure chamber 46 is of such configuration that it will fit snugly into the space bounded by the adjacent side walls 50 of further barrels of a cluster of barrels 45.

Further in each of the above embodiments the sleeve provided a relatively broad cylindrical surface which engages closely with the bore of the barrel so as to assist in preventing passage of ignited gases between the sleeve and the barrel. Further in the embodiments illustrated in FIGS. 2, 3 and 4 the inward projections on the sleeve engage within complementary recesses formed in the housing and provide a labyrinth type seal across the inner face of the sleeve.

In all the above embodiments the propellant in the high pressure chamber is adapted to be ignited by electronically controlled ignition means, as described in our earlier International Patent Applications.

Figure 6:
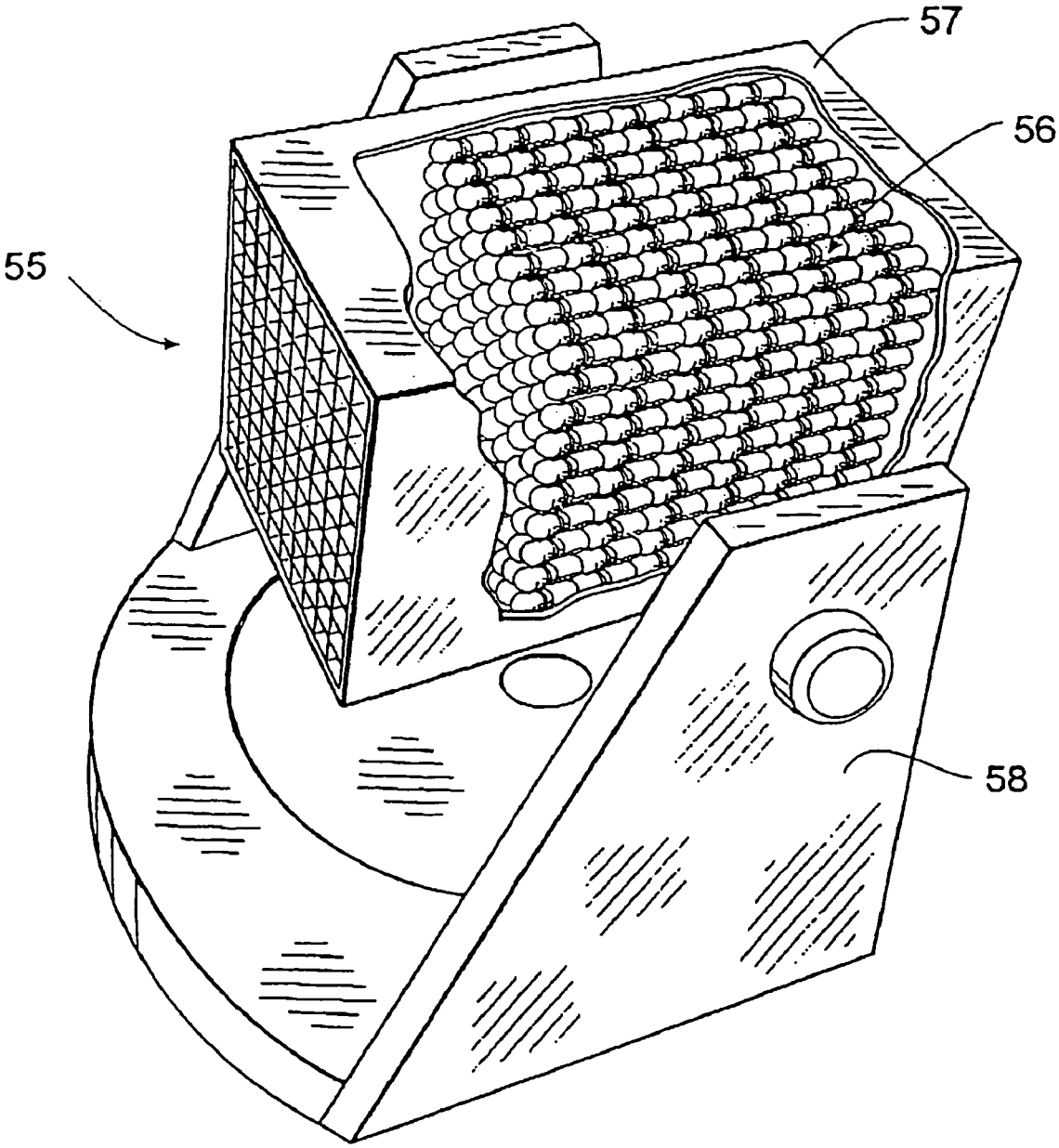
FIG. 6 illustrates a pod of grenade firing barrel assemblies.

As illustrated in FIG. 6, a typical weapon according to an embodiment of this invention includes a cluster of barrel assemblies 55 adapted to fire grenades 56 and contained in a pod 57 such that a selected number of near simultaneously exploding grenades may be fired at a time. The grenades 56 are fired selectively from the pod 57 by computer control. The weapon in the illustrated embodiment contains ninety-eight barrel assemblies each containing stacked grenades 56 and having selectively ignitable internal or external propellant charges. In this embodiment the pod 57 is carried on a turret mounting 58 whereby the barrels may be swivelled about vertical and horizontal axes for aiming purposes.

Suitably 40 mm grenades 56 are used as the projectiles because of their ready availability. The grenades 56 are fired selectively by computer control from the pod 57 which is envisaged will contain ninety-eight barrel assemblies each containing stacked grenades 56 and having selectively ignitable internal or external propellant charges. The grenades 56 may be selectively fired to form a controlled impact array of exploding grenades on the zone to be investigated.

By way of example, using such a barrel assembly in a pod of ninety-eight 40 mm barrels that would measure approximately 350 mm×700 mm in cross section, with each barrel loaded with six projectiles, and with each projectile similar in size to a conventional 40 mm military grenade, a barrel length of 900 mm would be required and the assembly would provide a projectile capacity of five hundred and eighty-eight projectiles. This configuration would be suitable for seismic applications requiring a short range such as for delivering projectiles from downwardly facing barrels. For longer range delivery fewer projectiles would be accommodated in each of such barrels or longer barrels would be used and more propellant would be utilised to achieve higher muzzle exit velocities.

The maximum rate of fire per barrel is expected to be as high as 20,000 projectiles per minute and the maximum rate for the combined ninety-eight barrels would be 1,960,000 projectiles per minute, assuming that all barrels are fired simultaneously at the maximum rate.

For a ninety-eight shot burst firing the leading round from each of the ninety-eight barrels, the rate is infinitely variable and which may be a ninety-eight shot burst fired at a rapid frequency.

The above ninety-eight barrel pod is one example of a range of performance specifications that could be available. Different performance specifications can be generated by altering the component parts of the pod. For example, a pod may be preloaded such that the nature and weight of the explosive and/or projectile may vary between individual barrels in the pod, or within a barrel.

A plurality of such pods 57 may be carried on a vehicle and arranged whereby each pod 57 may be selectively directed toward a desired target and fired at a selected rate. Alternatively the pods 57 may be fired collectively at a single target.

Figure 7:
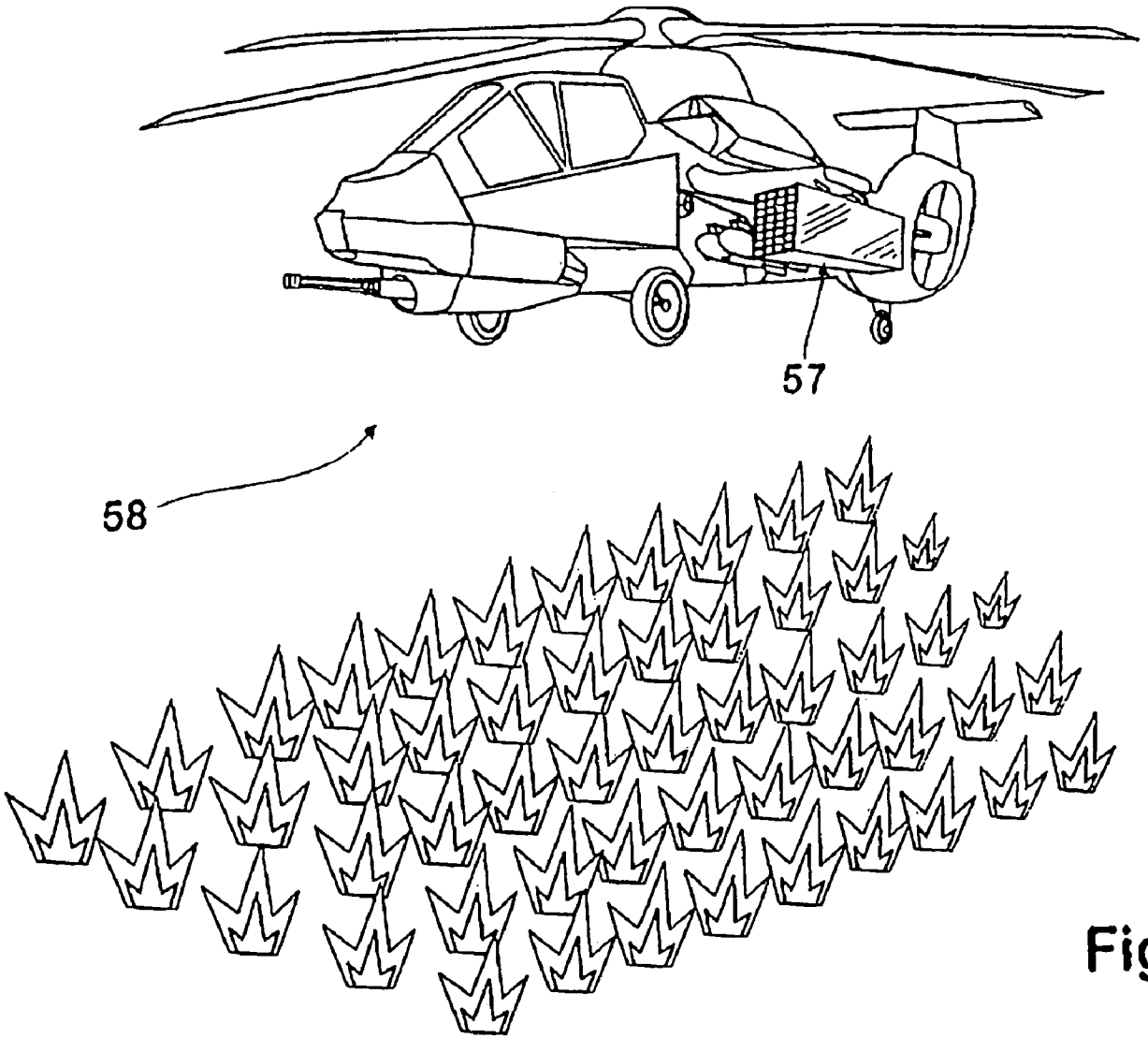
FIG. 7 illustrates a typical application of the present invention.

In the embodiment illustrated in FIG. 7, the grenades 56 are fired downwardly from a pair of such pods 57, only one of which is shown, carried by a helicopter 58 to provide bombing coverage of a tract of land. The density of such bombing and the area of land covered by the bombing can be controlled by controlling the variables such as rate of fire, elevation and speed of the aircraft.

Figure 8:
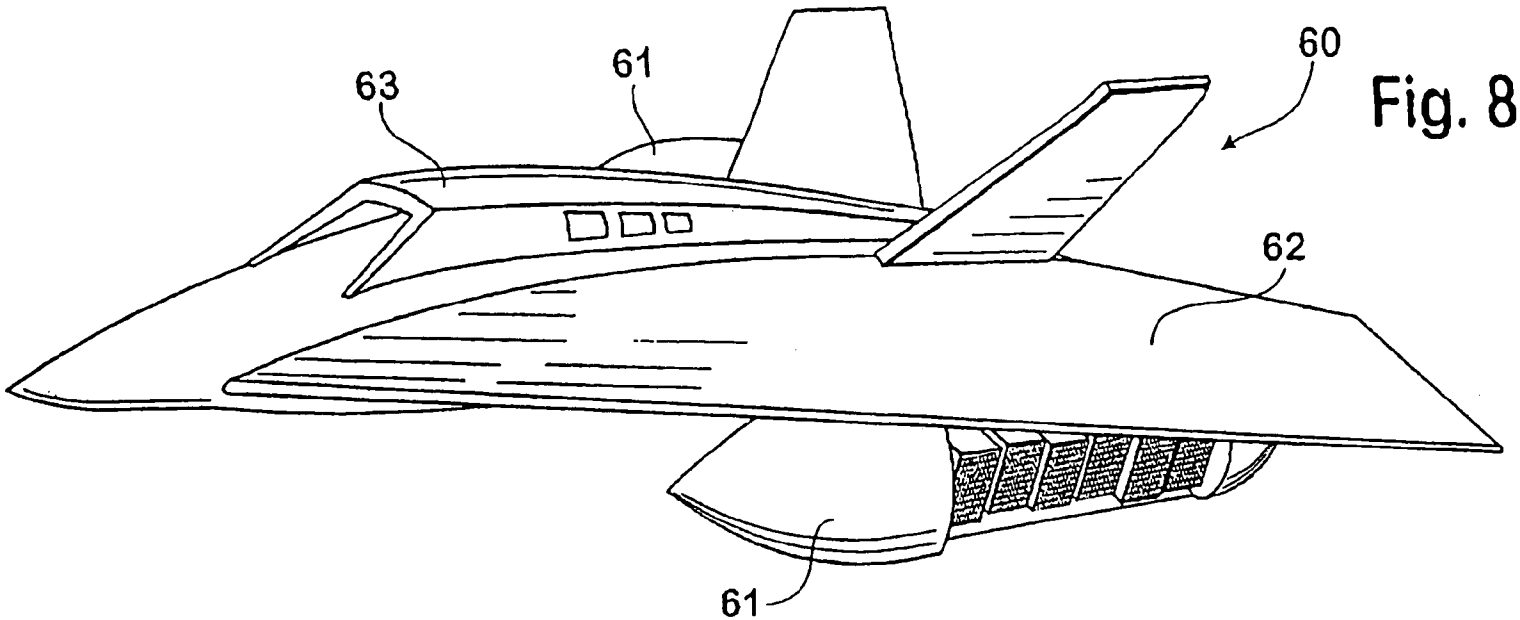
FIG. 8 illustrates a further application of the invention utilising an unmanned aerial vehicle.
Figure 9:
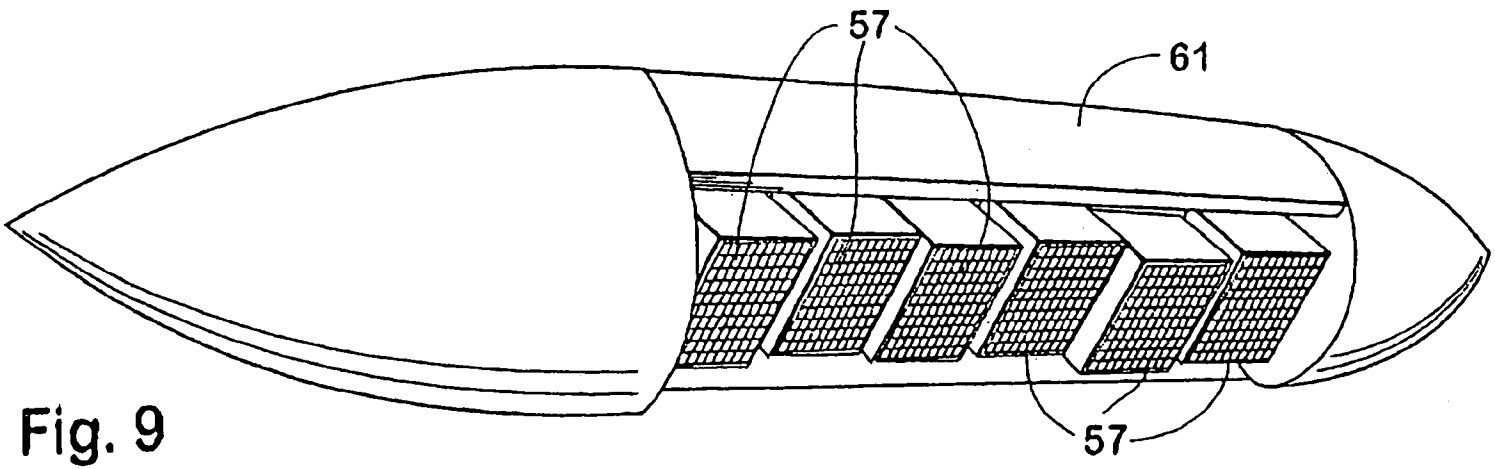
FIG. 9 is an underside view of one of the pod carriers of the aerial vehicle of FIG. 8.

The unmanned combat aerial vehicle 60 illustrated in FIGS. 8 and 9 carries six such pods 57 in cases 61 under the wings 62 at each side of the fuselage 63. It is envisaged that each pod could contain six 40 mm grenade pods with one hundred barrel assemblies per pod and with six grenades in each barrel. This would provide a loaded capacity of 7,200 grenades representing a payload of about 3,600 lb.

In this embodiment aiming of the barrels containing the grenades 56 would be achieved by remote control of the aircraft which may carry a video camera or the like for assisting its control remote from an operator.

Figure 10:
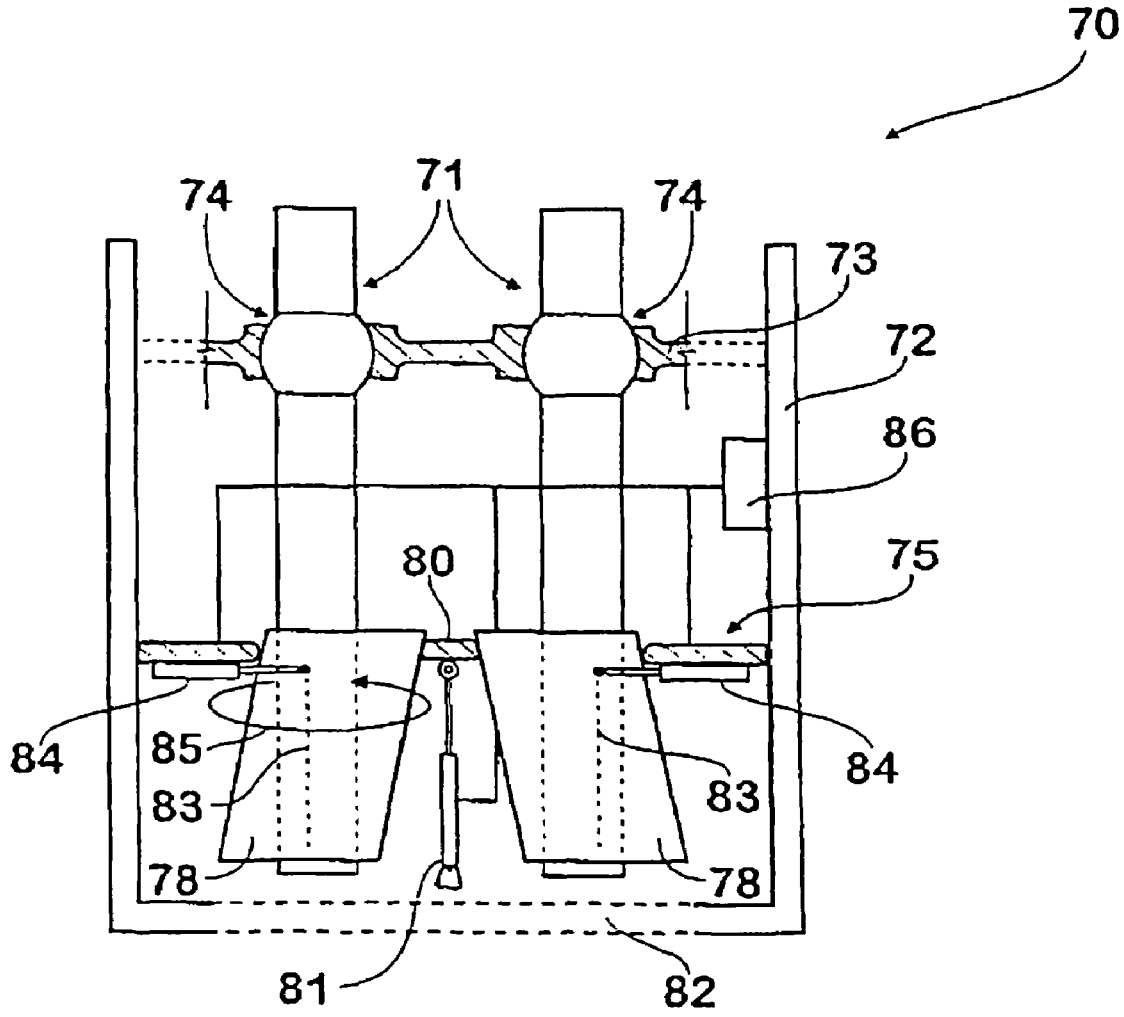
FIG. 10 is a diagrammatic cross-sectional view of a pod of splayable barrel assemblies.

The projectile firing pod 70 is illustrated diagrammatically in FIG. 10 and cutaway to illustrate only two barrel assemblies 71 of the type described which would be contained within a rectangular pod housing 72. The barrel assemblies 71 are swivel mounted in spaced apart relationship in the pod housing 72, being suspended from an upper wall 73 from respective ball type mountings 74.

Each barrel assembly 71 extends downwardly through the fixed ball-like mountings 74 to direction control means 75 which in this embodiment is able to individually or collectively control the barrel assemblies 71 for movement to an inclined attitude at one side or the other of their normal vertical position illustrated or to the front or back of that normal vertical position or to a combination of those attitudes as required.

For this purpose, each barrel assembly is provided with a cylindrical positioning block 78 supported rotatably about its lower end for eccentric motion about the axis of each barrel assembly. An intermediate wall 80 is apertured to closely receive each cylindrical positioning block 78. The vertical position of the intermediate wall 80 is controlled by a hydraulic ram 81 supported on the base wall 82 of the pod housing 72.

Extension and/or retraction of the ram 81 will move the intermediate wall 80 in a vertical direction restraining the respective apertures for movement along respective fixed axes so that, in the illustrated barrel assemblies, as the intermediate wall 80 moves downwardly, the lower ends of the barrel assemblies 71 will be moved inwards towards one another causing the barrel assemblies to splay outwardly relative to one another due to the fixed spacing of their upper ball mountings 74.

Accordingly, it will be seen that by controlling the position of the hydraulic ram 81 the barrel assemblies can be positioned with their axes vertical and parallel, inclined to the vertical and parallel, or with their axes in a splayed attitude relative to an axis of the pod.

Each positioning block may be selectively rotated about the lower end of the barrel assembly on which it is mounted by extension or retraction of a further hydraulic ram 84 supported on the intermediate wall 80 and extending to a track 83 in the outer side wall of the respective positioning block 78. The configuration of the track could be such that normal vertical movement of the intermediate wall 80 will not cause rotation of the blocks 78 in the direction of the arrow 85 unless the ram 84 is extended or retracted.

It will be seen that the vertical ram 81 connected to the intermediate wall 80 acts collectively on all barrel assemblies so as to move them in unison while individual horizontal rams 84 are provided for each barrel assembly 71.

These rams 84 may be individually controlled independent of the ram 81. Thus, for example, whereas the positioning blocks 78 are illustrated in the drawings arranged at opposing offsets with respect to the illustrated barrel assemblies 71, one of the positioning blocks could be rotated through 780° by its ram 84 so as to arrange both cylindrical positioning blocks 78 with their axes parallel to one another and at an identical offset to the axes of the associated barrel assemblies 71.

In this configuration, operation of the vertical ram 81 would pivot both barrel assemblies identically to one side or the other from the vertical, while at intermediate positions of one positioning block 78 relative to the other, splaying of the barrel assemblies could be achieved. Of course, both sets of rams 84 and 81 could be actuated simultaneously and be controlled by a suitable controller 86 to achieve a significant variation in target direction and spread of the fall of projectiles fired therefrom. In addition, the configuration of the impact pattern may be varied within a set zone. The barrel assemblies may also be controlled to provide a limited amount of turreting to achieve long range tight grouping of projectiles.

It will be seen that a projectile firing pod which may have an in-built remote controller 86, which may receiving information from orientation sensors mounted on or associated with the barrel assemblies or from the ram positions, may be readily delivered and deployed very quickly to a site even though that site may be off-level and thereafter remotely controlled to fire projectiles at a common or at varying inclinations to the vertical to achieve the desired fall of projectiles at the impact zone. Also, the proportions of the impact pattern may be varied or maintained constant with varying target spread areas.

The drives for rotating the blocks 78 could be independent of the intermediate wall 80, such as rotary drives with flexible or splined drives to the base of the barrel assemblies. Further the base 82 could be inclined to the side walls or be jackable to an inclined position to provide a coarse inclination toward the target zone with final aiming control achieved remotely by the direction control means 75.

A typical application of pods described above, as illustrated in FIG. 11 could be to fire a selected array of projectiles containing fuel to be dispersal therefrom in a controlled manner and pattern to form a defined fuel/air cloud to be detonated by further projectiles fired from the same pod or pods.

For example the fuel containing projectiles could form a fuel/air cloud 90 in a substantially conical shape and detonation could be effected simultaneously from a plurality of locations 91 about the upper portion of the cone to form a focused explosion directed to the desired target 92.

The size and height of the cloud could 90 be selected to deliver high pressure shock waves to a localised area. This could be utilised to explode a land mine field, as a lethal anti-personnel attack or, by further elevating the cloud 90 to provide a concussive non-lethal attack against ground troops.

It will of course be realised that the above has been given only by way of illustrative examples of the invention and that all such modifications and variations thereto as would be apparent to persons skilled in the art are deemed to fall within the broad scope and ambit of the invention as is defined by the appended claims.

The invention claimed is:

1. A barrel assembly comprising:

a barrel comprising a plurality of external chambers containing respective propellant charges;

a plurality of projectiles stacked nose to tail within the barrel and comprising respective expansion spaces for propellant gases;

wherein each projectile corresponds to an external chamber in the barrel and an expansion space, each of said projectiles having a tail structure that determines the respective expansion space in conjunction with the respective trailing projectile, and wherein each external chamber comprises a port that conveys propellant gas from the external chamber into the expansion space for propulsion of the respective projectile, the tail structure of each projectile having a passage aligned with the port of a respective external chamber for flow of propellant gas from the external chamber into the respective expansion space; and a control system configured to ignite the propellant charges to create the propellant gases and propel the projectiles sequentially from the barrel.

* * * * *